US009750970B2

(12) United States Patent
Kennedy

(10) Patent No.: US 9,750,970 B2
(45) Date of Patent: Sep. 5, 2017

(54) HAND HELD EXERCISE DEVICE

(71) Applicant: Robert Kennedy, Ottawa (CA)

(72) Inventor: Robert Kennedy, Ottawa (CA)

( * ) Notice: Subject to any disclaimer, the term of this patent is extended or adjusted under 35 U.S.C. 154(b) by 48 days.

(21) Appl. No.: 14/727,943

(22) Filed: Jun. 2, 2015

(65) Prior Publication Data

US 2016/0354630 A1 Dec. 8, 2016

(51) Int. Cl.
*A63B 5/22* (2006.01)
*A63B 21/00* (2006.01)
(Continued)

(52) U.S. Cl.
CPC ..... *A63B 21/4049* (2015.10); *A63B 21/0004* (2013.01); *A63B 21/0608* (2013.01);
(Continued)

(58) Field of Classification Search
CPC ..... A63B 5/20; A63B 15/00; A63B 15/005; A63B 21/0004; A63B 21/00043; A63B 21/00058; A63B 21/00061; A63B 21/00065; A63B 21/00069; A63B 21/00072; A63B 21/00076; A63B 21/00185; A63B 21/06; A63B 21/0608; A63B 21/062; A63B 21/0622; A63B 21/0624; A63B 21/0626; A63B 21/0628; A63B 21/063; A63B 21/0632; A63B 21/068; A63B 21/08; A63B 21/22; A63B 21/222; A63B 21/4017; A63B 21/4019; A63B 21/4023; A63B 21/4025; A63B 21/4033; A63B 21/4035; A63B 21/4039; A63B 21/4043; A63B 21/4047; A63B 21/4049; A63B 23/035; A63B 23/03508; A63B 23/03516; A63B 23/03533; A63B 23/03541; A63B 23/03575; A63B 23/12; A63B 23/1209; A63B 23/1245; A63B 23/1254; A63B 23/1263; A63B 23/1272; A63B 23/1281; A63B 23/14; A63B 23/16; A63B 71/0054; A63B 2071/0063;
(Continued)

(56) References Cited

U.S. PATENT DOCUMENTS 1,462,088 A * 7/1923 La Sares ..... A63B 5/20 16/430
1,658,108 A * 2/1928 Vaughn ..... A63B 15/00 482/109

(Continued)

*Primary Examiner* — Sundhara Ganesan
*Assistant Examiner* — Gary D Urbiel Goldner
(74) *Attorney, Agent, or Firm* — Gearhart Law LLC

(57) ABSTRACT

The exercising device preferably has a handle with a proximal end and a distal end and a swing arm having a first end and a second end. The proximal end of the handle is rotatably connected to the first end of the swing arm, allowing the swing arm to rotate around the proximal end of the handle in a "clock-hand" fashion. A connecting shaft and swing arm stopper prevent the swing arm and handle from becoming separated during use. The exercising device may further have a weight member positioned in a weight member recess located close to the second end of the swing arm. The weight member increases the difficulty of using the exercise device and is removably attached to the swing arm. A safety sleeve can fit over the weight member recess to prevent the weight member from dislodging during use.

14 Claims, 5 Drawing Sheets

(51) Int. Cl.

| | |
|---|---|
| ***A63B 21/06*** | (2006.01) |
| ***A63B 23/12*** | (2006.01) |
| *A63B 21/22* | (2006.01) |
| *A63B 5/20* | (2006.01) |
| *A63B 23/035* | (2006.01) |
| *A63B 69/00* | (2006.01) |
| *A63B 71/00* | (2006.01) |
| *A63B 21/015* | (2006.01) |
| *A63B 21/072* | (2006.01) |
| *A63B 23/04* | (2006.01) |
| *A63B 23/00* | (2006.01) |

(52) U.S. Cl.
CPC .... *A63B 21/4035* (2015.10); *A63B 23/03508* (2013.01); *A63B 23/1209* (2013.01); *A63B 5/20* (2013.01); *A63B 21/00061* (2013.01); *A63B 21/00069* (2013.01); *A63B 21/015* (2013.01); *A63B 21/072* (2013.01); *A63B 21/22* (2013.01); *A63B 23/03525* (2013.01); *A63B 23/03541* (2013.01); *A63B 23/03575* (2013.01); *A63B 23/0458* (2013.01); *A63B 23/0482* (2013.01); *A63B 69/0028* (2013.01); *A63B 71/0054* (2013.01); *A63B 2023/003* (2013.01); *A63B 2208/0204* (2013.01); *A63B 2208/0209* (2013.01); *A63B 2208/0223* (2013.01); *A63B 2209/02* (2013.01); *A63B 2209/08* (2013.01); *A63B 2209/10* (2013.01); *A63B 2210/50* (2013.01); *A63B 2225/09* (2013.01)

(58) Field of Classification Search
CPC .... A63B 2071/0072; A63B 2071/0081; A63B 2071/009; A63B 2208/0204; A63B 2208/0209
See application file for complete search history.

(56) References Cited

U.S. PATENT DOCUMENTS 2,991,585 A * 7/1961 Drees ..... A63F 7/382 446/266
3,037,322 A * 6/1962 Baumgartner, Jr. ... A63H 33/00 362/35
3,162,975 A * 12/1964 Amato ..... A63H 5/00 43/3
3,414,260 A * 12/1968 Gust ..... A63B 15/00 473/256
3,636,811 A * 1/1972 Bailey ..... G10G 7/00 84/477 B
3,672,093 A * 6/1972 Meek, Sr. ..... A63B 21/0608 446/266
4,043,553 A * 8/1977 Suarez ..... A63B 21/0608 482/106
4,132,409 A * 1/1979 Taylor ..... F41B 15/02 463/47.6
4,249,762 A * 2/1981 Richards ..... A63B 15/00 473/256
4,351,526 A * 9/1982 Schwartz ..... A63B 21/0726 482/105
4,379,552 A * 4/1983 Webb ..... A63B 21/015 482/118
4,513,963 A * 4/1985 Nelson ..... A63B 21/0608 482/110
4,627,618 A * 12/1986 Schwartz ..... A63B 21/072 482/105
4,647,037 A * 3/1987 Donohue ..... A63B 5/20 482/108
4,664,370 A * 5/1987 Finch ..... A63B 23/12 482/45
4,693,469 A * 9/1987 Cedar ..... A63B 21/0608 482/110
4,778,173 A * 10/1988 Joutras ..... A63B 5/20 482/108
4,787,623 A * 11/1988 Cedar ..... A63B 21/0608 482/110
4,801,137 A * 1/1989 Douglass ..... A63B 21/075 482/108
4,869,492 A * 9/1989 Joutras ..... A63B 5/20 482/116
4,964,636 A * 10/1990 Ashihara ..... F41B 15/02 463/47.4
4,982,950 A * 1/1991 Petrosky ..... A63B 21/0608 482/45
5,033,740 A * 7/1991 Schwartz ..... A63B 21/0722 482/105
5,135,455 A * 8/1992 King et al. ..... A63B 21/0726 482/105
5,192,074 A * 3/1993 Ashihara ..... F41B 15/02 463/47.4
5,478,297 A * 12/1995 Dennis, Jr. ..... A63B 5/20 482/81
6,544,148 B1 * 4/2003 Loew ..... A63B 21/0728 482/82
6,776,742 B2 * 8/2004 Domenge ..... A63B 21/0608 482/110
6,916,104 B2 * 7/2005 Parsons ..... F21L 4/005 362/109
7,621,854 B2 * 11/2009 Foxman ..... A63B 5/20 482/81
7,628,735 B1 * 12/2009 Hsu ..... A63B 5/20 482/108
7,976,438 B1 * 7/2011 Hsu ..... A63B 5/20 482/81
8,062,193 B2 * 11/2011 Oesterling ..... A63B 5/20 403/329
9,381,391 B1 * 7/2016 Welty, II ..... A63B 5/20
2004/0002408 A1 * 1/2004 Rigas ..... A63B 5/20 482/82
2006/0128534 A1 * 6/2006 Roque ..... A63B 15/00 482/82
2006/0166795 A1 * 7/2006 Domenge ..... A63B 21/06 482/110
2008/0287273 A1 * 11/2008 Ma ..... A63B 21/0552 482/108
2010/0160116 A1 * 6/2010 LaTour ..... A63B 5/20 482/8
2010/0298100 A1 * 11/2010 McVan ..... A63B 21/0004 482/45
2013/0165299 A1 * 6/2013 Hunt ..... A63B 5/20 482/82
2015/0057133 A1 * 2/2015 Nguyen ..... A63B 21/4019 482/93
2015/0119206 A1 * 4/2015 Newman ..... A63B 5/20 482/82
2016/0151657 A1 * 6/2016 Kugielsky ..... A63B 21/072 482/93

* cited by examiner

HAND HELD EXERCISE DEVICE

CLAIM OF PRIORITY

This application is a non-provisional application and claims no priority to any other patent or patent application.

FIELD OF THE PREFERRED EMBODIMENTS

The current invention and its embodiments relate to a device used for physical exercise. In particular, the current invention relates to an exercising device employing a handle-swing arm assembly that may be used for different types of physical exercises.

BACKGROUND OF THE PREFERRED EMBODIMENTS

In this day and age, physical exercise has become an indispensable part of many people's lives. As a significant portion of the population does not engage in any physical endeavor at their workplace, it has become important and fashionable to exercise with or without the assistance of specially designed exercising devices. Physical exercise may be divided into several categories, such as flexibility exercises, aerobic exercises, and anaerobic exercises. To fit the needs of different persons and different exercising routines, various kinds of exercising apparatus and devices have been developed. However, devices that are simple, versatile and effective are always in great demand.

Rope jumping has been a standard exercising routine for a long time. It is widely practiced because it is highly effective in toning a person's calves, thighs, arms, wrists, and improving overall physical conditions and endurance. To enhance the results, people have introduced "heavy ropes" weighing much more than the regular ropes. However, rope jumping as a whole, and particularly the use of heavy ropes, presents some problems. For example, ropes, particularly the heavy ropes, may be bulky and difficult to carry around. In addition, the weight of a particular rope is not adjustable, making it difficult to fit the different needs of various users. Moreover, jumping ropes may entail tripping on the ropes and further injuries and damages.

The current invention introduces a device that mimics the rope jumping motions when it is used in a specific manner, with great effectiveness and results. Further, the device promotes improvements in both muscular strength/endurance and cardiovascular health. In addition, the current invention addresses all the problems inherent with the rope jumping exercise. More importantly, with the current invention, which is much more versatile, the user may perform many more exercising routines and achieve better and complete results.

SUMMARY OF THE PREFERRED EMBODIMENTS

The present invention and its embodiments describe and teach an exercise device having a handle with a proximal end and a distal end; a swing arm having a first end and a second end; wherein the proximal end of the handle is rotatably connected to the first end of the swing arm, allowing the swing arm to rotate around the proximal end of the handle in a clock-hand fashion.

In another embodiment of the present invention there is an exercise device having a handle having a proximal end and a distal end; a swing arm having a first end, a second end, a shaft hole located at the first end, and a weight member recess positioned close to the second end, a connecting shaft affixed to the proximal end of the handle, wherein and a front end of the connecting shaft is inserted into the shaft hole, allowing the first end of the swing arm to be rotatably connected to the proximal end of the handle, and holding the handle and wielding the exercising device drives the swing arm to rotate around the proximal end of the handle (in either direction) in a clock-hand fashion; a swing arm locator removably attached to the connecting shaft, preventing the connecting shaft to dislodge from the shaft hole; a weight member, wherein the weight member is positioned in the weight member recess and removably attached to the swing arm; a safety sleeve removably attached to the second end of the swing arm and partially covering the weight member recess, preventing the weight member to be relieved from the weight member recess; a grip cover covering the handle; a handle strap having an anchoring end and an adjustable end; wherein the anchoring end attaches to the connecting shaft, and the adjustable end removably connects to the distal end of the handle; and a handle cap capable of covering the distal end of the handle, preventing the adjustment end of the handle strap to be detached from the distal end of the handle.

Generally, the present invention and its embodiments provide for an exercise device that can be used to facilitate or enhance a number of exercises. The handle and the swing arm of the exercise device may be viewed as an assembly, which is the central mechanism of the current device. Rotation in a "clock-hand" fashion, in the current invention, refers to the rotation of the swing arm around the proximal end of the handle. The swing arm is analogous to a clock hand, while the proximal end of the handle is similar to the center of the clock. "Clock-hand" rotation indicates the manner in which the swing arm circles around the proximal end of the handle—like a clock arm rotates around the center of the clock. Such a motion may be achieved in a "clock wise" and/or "counter clockwise" fashion.

However, it should be fully noted that the rotation of the swing arm in the current device may be clockwise or counterclockwise, not being limited by the movements by actual clock hands. With such a design, a user of the exercising device may hold the handle and wield the exercising device so that the swing arm may rotate around the proximal end of the handle. Here, "wielding" is a motion exerted by the user, so that the proximal end of the handle may swirl around a central hypothetical axis. The distal end of the handle remains relatively still or swirl with a smaller radius, compared to the proximal end.

The exercising device may further comprise a weight member, wherein there is a weight member recess located close to the second end of the swing arm, and the weight member is positioned in the weight member recess and removably attached to the swing arm. According to this design, the weight member is in proximity to the second end of the swing arm, which is the farthest point to the center of the rotation, the proximal end of the handle. The weight member is preferred to be made from materials having higher density than other parts of the exercising device. Moreover, the weight member is preferred to be heavy compared with other parts of the exercising device so that the weight center of the swing arm-weight member combination may be shifted towards to the second end. Such a design facilitates the rotation of the swing arm and provides further challenges to the user of the device.

In general, the present invention succeeds in conferring the following, and others not mentioned, benefits and objectives.

It is an object of the present invention to provide an exercise device that can be used for a variety of exercises in a multitude of different settings.

It is an object of the present invention to provide an exercise device that is durable.

It is an object of the present invention to provide an exercise device that is adjustable to conform to a user's needs.

It is an object of the present invention to provide an exercise device that is lightweight and inexpensive.

It is an object of the present invention to provide an exercise device that limits or prevents user injuries.

It is an object of the present invention to provide an exercise device that is easily stored and transported.

It is an object of the present invention to provide an exercise device that can be used by individuals of all ages.

DETAILED DESCRIPTION OF THE PREFERRED EMBODIMENTS

Figure 1:
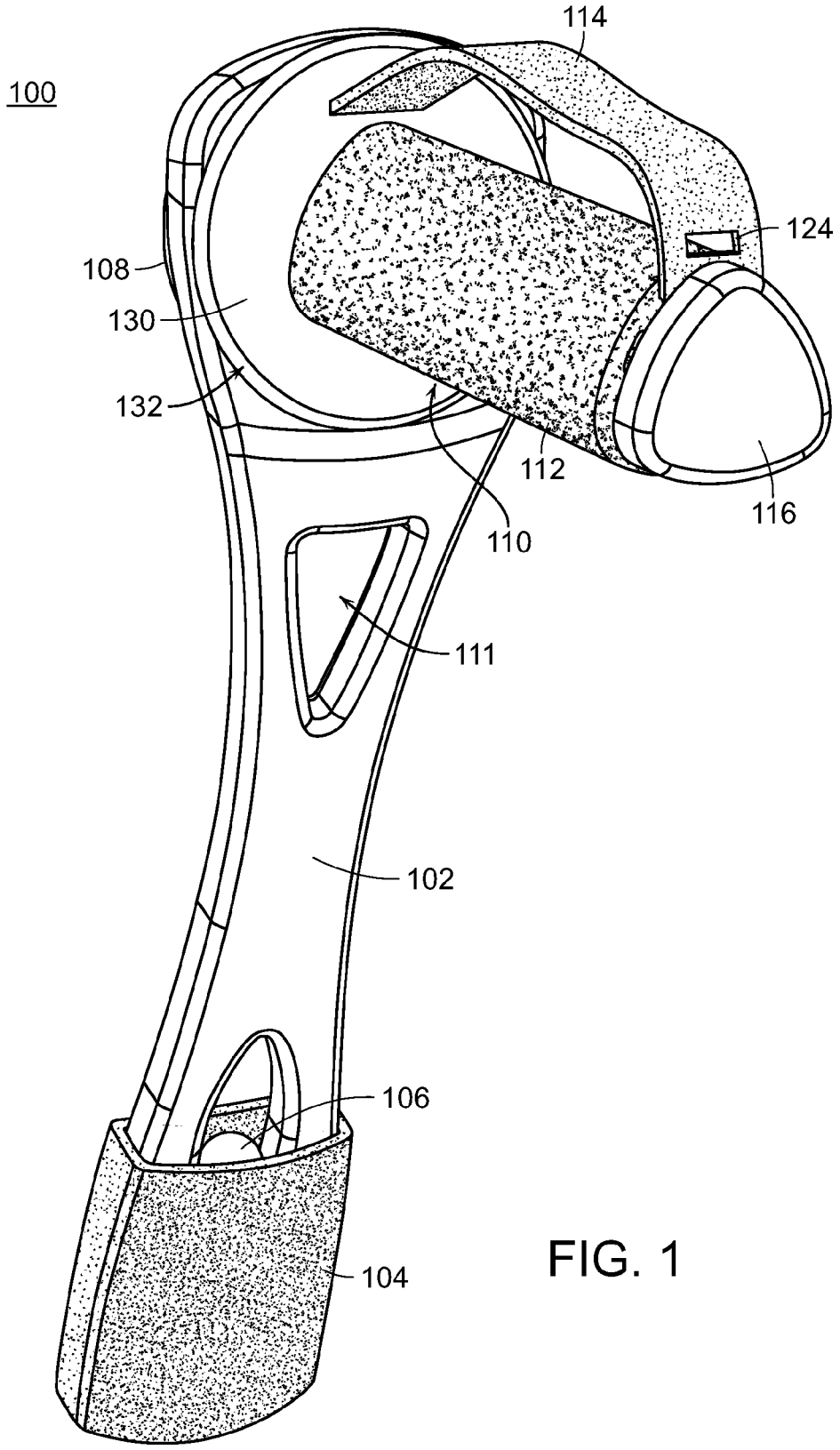
FIG. 1 is a first perspective view of an embodiment of the present invention.

The preferred embodiments of the present invention will now be described with reference to the drawings. Identical elements in the various figures are identified, as far as possible, with the same reference numerals.

Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

Figure 2:
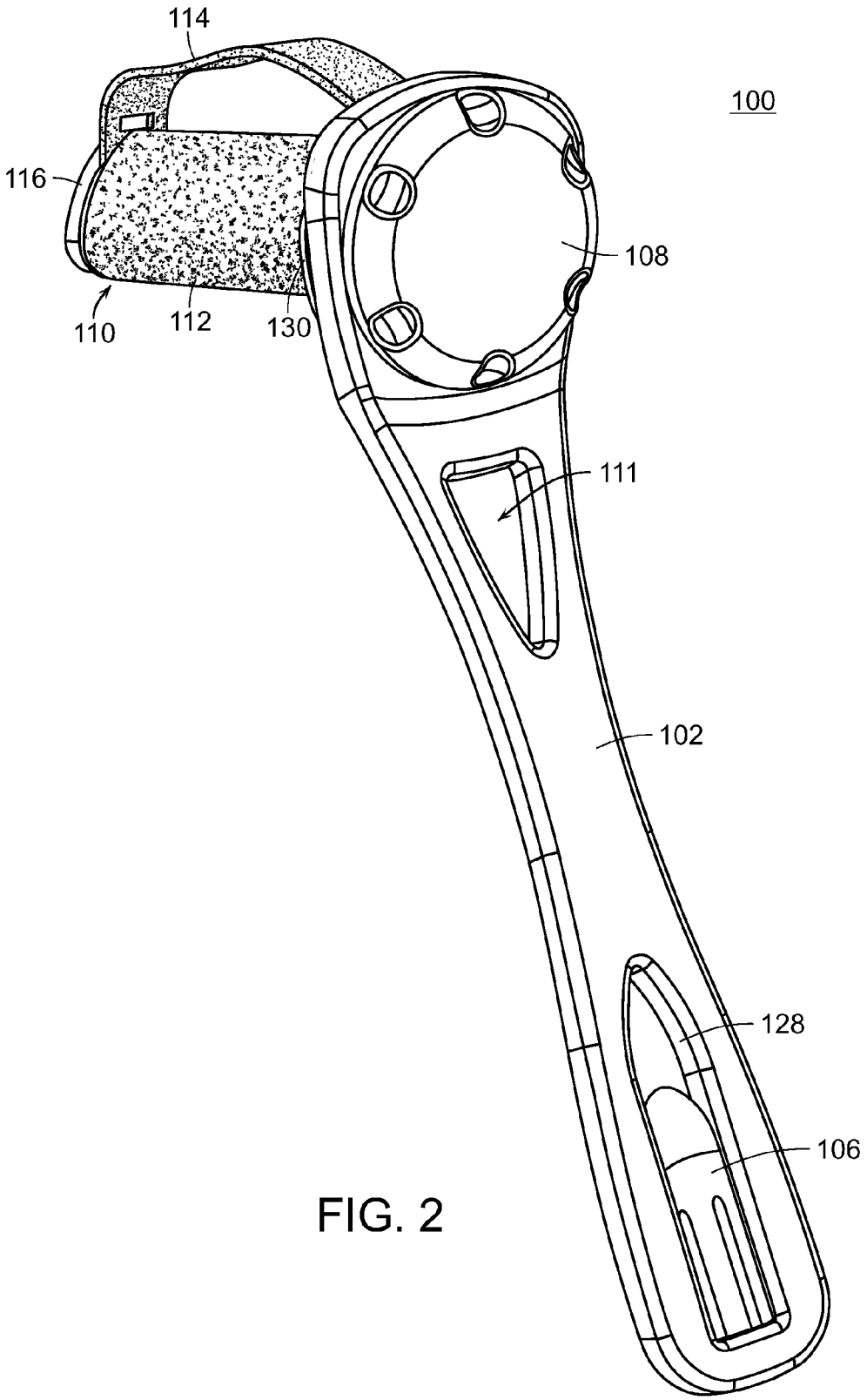
FIG. 2 is a second perspective view of an embodiment of the present invention.

Referring now to FIGS. 1 and 2, there is a perspective view taken respectively from each side of the exercising device 100. Generally, the exercising device 100 has a swing arm 102 coupled to a handle 110. The swing arm 102 may have a weight member 106 located within a weight member recess 128.

The weight member 108 and weight member recess 128 are preferably covered with safety sleeve 104 to prevent the weight member 108 from becoming dislodged from the exercising device 100 during use. The safety sleeve 104 serves to keep the weight member 106 in place and prevent injury and accident in case the weight member 106 is released inadvertently. Preferably, to remove and change the weight member 106, the safety sleeve 104 must be removed first. Additionally, apertures 111 may exist to remove weight from the swing arm 102 or to help to more evenly distribute the weight of the exercising device 100. The swing arm 102 is coupled to the handle 110 via a shaft hole 118 (see FIG. 3) and connecting shaft 130. The swing arm stopper 132 prevents the handle 110 from passing through the shaft hole.

The handle 110 preferably has a grip cover 112 to aid in the gripping and handling of the exercising device 100. A swing arm locator 108 fits over the shaft hole opposite the side of insertion of the handle 110. The handle 110 has a handle strap 114 which is adjustable. The handle cover 116 can be removed to reposition the handle strap 114 along the adjustment hole(s) 124.

Figure 3:
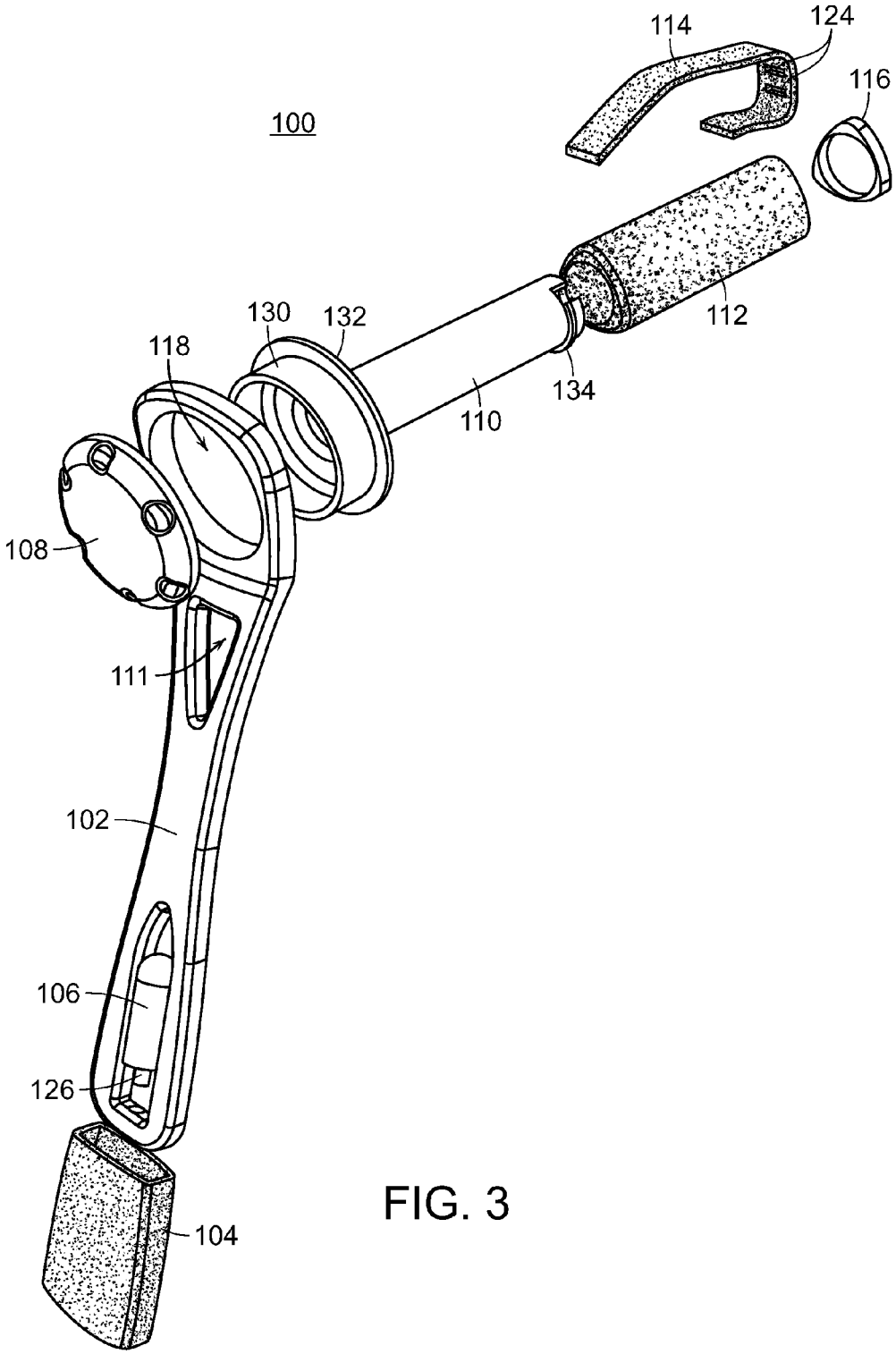
FIG. 3 is an exploded view of the components of an embodiment of the present invention.

In FIG. 3, there is an exploded view demonstrating the relationship of the components of the exercising device 100 to one another. Shown are the swing arm 102, handle 110, weight member 106, safety sleeve 104, apertures 111, swing arm locator 108, connecting shaft 130, shaft hole 118, handle 110, grip cover 112, safety strap 114, adjustment holes 124, and handle cap 116. There are many ways to rotatably connect the proximal end of the handle 110 to the first end of the swing arm 102. As long as a rotatable connection may be established, any method is acceptable.

As an example, the exercising device 100 may further include a connecting shaft 130 affixed to the proximal end of the handle 110, wherein there is a shaft hole 118 located at the first end of the swing arm 102, and a front end of the connecting shaft 130 is inserted into the shaft hole 118. The connecting shaft 130 may include a swing arm stopper 132 so that when the front end of the connecting shaft 130 is inserted into the shaft hole 118, the swing arm 102 is blocked by the swing arm stopper 132.

The exercising device 100 may further include a swing arm locator 108 removably attached to the front end of the connecting shaft 130, preventing the connecting shaft 130 to dislodge from the shaft hole 118. With such a design, the swing arm 102 is clamped between the swing arm locator 108 and the swing arm stopper 132, while the front end of the connecting shaft 130 is positioned within the shaft hole 118. The swing arm 102 may thus rotate around the proximal end of the handle 110 without being dislodged.

The connecting shaft 130 may be bigger, the same, or smaller compared with the handle 110. Preferably, the connecting shaft 130 has a shaft diameter larger than the handle's diameter. The shaft diameter may fit into the shaft hole 118, allowing a smooth rotation. The device may also include a dial so that the rotation tension may be adjusted, making the device more versatile.

The exercising device 100 may further include a grip cover 112 covering the handle 110. The grip cover 112 is designed to prevent slipping provide comfort to the user. To further improve safety, the exercising device 100 may include a handle strap 114 having an anchoring end and an adjustable end, wherein the anchoring end attaches to the connecting shaft 130, and the adjustable end removably connects to the distal end of the handle 110. When the user take hold of the handle 110, the handle strap 114 covers the back of the user's hand and prevents the inadvertent release of the handle 110.

The shape of different components of the exercising device 100 may vary according to the needs of the user, the ease of manufacturing, and the overall design. Preferably, the handle 110 is a round bar and the swing arm 102 is an elongated flat penal having a first section near or at the first end and a second section near or at the second end. The shaft hole 118 is included in the first section and the weight member recess is in the second section. The first section and second section may both be perpendicular to the handle 110. Alternatively and preferably, the first section is perpendicular to the handle 110 and the second section and the handle 110 form an obtuse angle. Such a design facilitates the wielding motion and the rotation of the swing arm 102.

Figure 4:
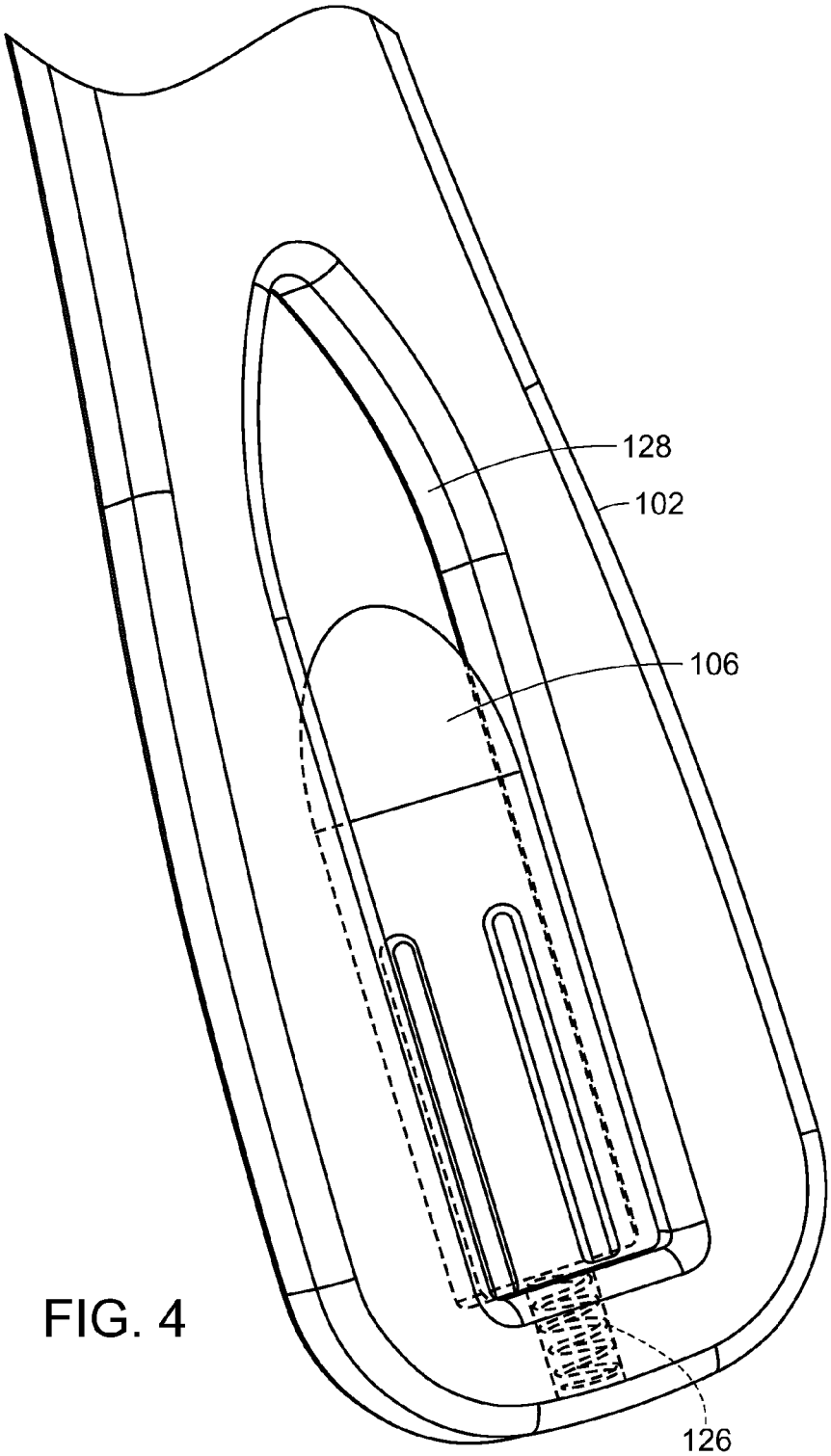
FIG. 4 is a close up view of the swing arm of an embodiment of the present invention illustrating the slidable weight mechanism.

Referring to FIG. 4, the weight member 106 is kept in the weight member recess 128 and is preferably removably attached to the swing arm 102. "Removable attachment" as used herein and for other parts of the device, refers to attachments that may be reversed without affecting the physical integrity of the various components. Preferably, the weight member 106 is coupled via a fastening mechanism 126 such as a threaded bolt in the weight member recess 128.

However, it should be noted that other methods of removable attachments may also be used, including but not limited to magnetic connections, plug-in connections, snaps, and other assembling structures such as a straps and hook-and-loop mechanisms. Different weight members 106 having different sizes and weights may be used and may replace one another so that the particular weight experienced by the user may be adjusted to fit the needs of specific users and specific exercising routines. Once a weight member 106 has been selected the second end of the swing arm 102 should be covered with the safety sleeve thereby keeping the weight member 106 within the confines of the weight member recess 128.

Figure 5:
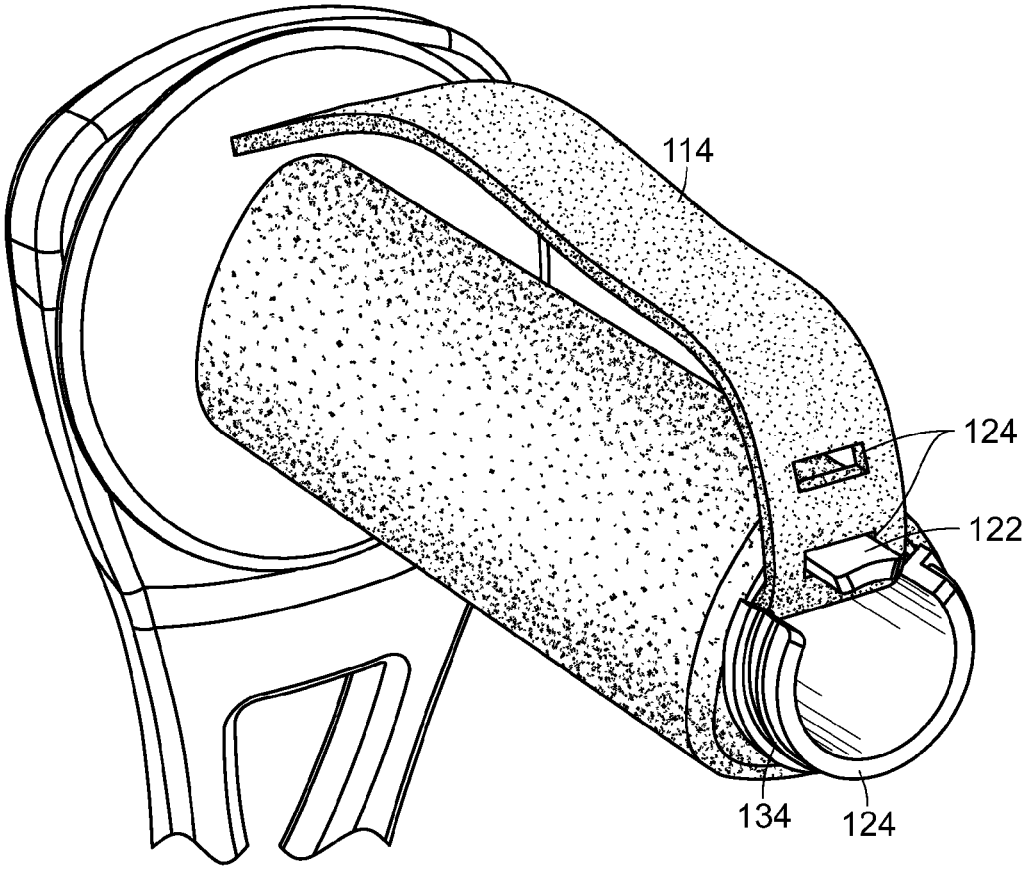
FIG. 5 is a close up view of the handle demonstrating the adjustability of the handle strap.

Referring now to FIG. 5, to suit different hand sizes, it is preferred that the handle strap 114 is adjustable. For example, the hand strap may have a plurality of adjustment holes 124 on the adjustable end and there may be a protruding member 122 on the distal end of the handle and the protruding member 122 is capable of being inserted into each adjustment hole 124. By inserting the protruding member 122 into different adjustment holes 124, the length of the handle strap 114 covering the hand is changed.

In addition, there may be a handle cap 116 (see FIG. 3) capable of covering the distal end of the handle 110, preventing the adjustment end of the handle strap 114 to be detached from the distal end of the handle 110. Preferably, each time when the handle strap 114 needs adjustment, the user may remove the handle cap, reinsert the protruding member 122 into a different adjustment hole 124, and put the handle cap back on. The handle cap may attach to the handle via threads 134 or other comparable mechanisms.

The exercising device 100 disclosed in FIGS. 1-5 may be used for many kinds of exercising routines. While most of the exercising routines involve wielding and swinging the exercising device 100 and rotation of the swing arm, there is no requirement that such is the case. The exercising device 100 disclosed by the current invention may be used as a simple weight. Nevertheless, in most suitable routines, the user takes hold of the handle 110 and wields the swing arm 102, toning different muscle groups of the body and causing different physical improvements.

In addition to the simple wielding motion, the current device may be combined with other physical exercises and movements of various parts of the user's body, achieving complete training results. The applications are almost limitless and it is impossible to summarize all. Here are several kinds of exercises that may serve as examples.

The most basic form of exercise that may use this device is side spinning. The user may hold one or two devices in one or both of his/her hands and wield the exercising device 100 so that the swing arm 102 rotates beside his/her body. In a way, it is similar to a rope jumping exercise, just without the ropes. In the mean time, the user may engage in a stepping exercise, either continuously forward, up and down a bench, or remaining at the same place. The user may even jog or run to compliment the upper body movements. Such a routine trains both lower and upper body strength, as well providing an aerobic exercise. Alternatively, the user may also stand still to focus on arm and chest toning. The swing arm 102 may rotate forward or backward. The user's arm(s) may be extended or bent. The wielding may be fast or slow. The user may make almost limitless adjustments according to his/her needs and physical conditions.

In another exercising routine, the user may keep his/herself in an upright position, either standing or squatting, and wield the current device over his/her head. In this exercise, the handle 110 is upright and the swing arm 102 rotates in a horizontal plain. The user may hold one device with both his/her hands. Or the user may hold two with one in each hand. In a similar exercise, the user may extend his/her arms forward and wield the device in front, as indicated in another picture.

Wielding the current device may be combined with specific body positions and motions. For example, while wielding the device, the user may engage in a lunge stance—extending one leg back and flexing another in the front. During the exercise, the user may change his/her lunge height, alter the front and back legs, and bounce his/her body consistently. In addition, in an exercise where the user wields the device in front of his/her body, the user may rotate his/her torso from side to side, while maintaining the wielding motions. The user may also lift one foot at a time, conducting extra balancing exercise as the same time.

A complete exercising process using the current device may involve a series of sessions employing the same or different routines. Not necessarily every one of these sessions requires using the exercising device 100. When the exercising device 100 is used, it may be employed as a simple weight block. The user may conduct some routines while carrying or lifting the current device, without wielding it. In other sessions, as indicated above, the user may wield the device and conduct various routines. Moreover, between the sessions the user may have intervals or rest or relaxations so that he/she may recover from the previous session.

The various components of the exercising device 100 may be made from the same or different materials, including but not limited to metal, wood, rubber, composite materials, glass including but not limited to fiberglass, and hard plastics such as but not limited to polyethylene terephthalate (PET), high-density polyethylene, polyvinyl chloride (PVC), polyvinylidene chloride (PVDC), polystyrene (PS), high impact polystyrene (HIPS) and polycarbonate (PC), or some combination thereof. Each component of the exercising device 100 may have its preferred material. For example, the swing arm 102 and handle 110 are preferably made from molded plastic, the weight member 106 is preferably made from steel or other metals, the safety sleeve 104 and the handle strap 114 are preferably made from rubber, and the grip cover 112 is preferably made from foam.

The dimensions of the components may also vary significantly according to the need of the user and the specific exercising routine. In general, the handle 110 is preferred to have a length of about 8 cm to about 30 cm, with the more preferred range of about 12 cm to about 18 cm, the first section of the swing arm 102 is preferred to have a length of about 4 cm to about 12 cm, with the more preferred range of about 6 cm to about 9 cm, the second section of the swing arm 102 is preferred to have a length of about 10 cm to about 40 cm, with the more preferred range of about 20 cm to about 30 cm, the handle 110 is preferred to have a diameter of about 1 cm to about 6 cm, with the more preferred range of about 2 cm to about 4 cm, and the connecting shaft 130 is preferred to have a diameter of about 2 cm to about 12 cm, with the more preferred range of about 4 cm to about 8 cm.

The exercising device 100 is preferably light weight so that it is easily portable. Without the weight member 106, the rest of the device may weigh from about 200 g to about 20 kg. As indicated above, different weight members 106 having different weights and sizes may be attached to the swing arm. The weight member 106 may weigh between about 100 g to about 20 kg, with the preferred weight range of about 200 g to about 5 kg.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. An exercising device, comprising:

a handle having a proximal end and a distal end;

a swing arm having a first end and a second end, wherein the proximal end of the handle is rotatably coupled to the first end of the swing arm thereby allowing the swing arm to rotate around the proximal end of the handle;

a connecting shaft disposed on the proximal end of the handle, wherein there is a shaft hole located near the first end of the swing arm, and wherein the connecting shaft is inserted into the shaft hole;

a swing arm locator removably coupled to the connecting shaft thereby preventing the connecting shaft from disengaging from the shaft hole, wherein the connecting shaft has a shaft diameter larger than a diameter of the handle.

2. The exercising device of claim 1, wherein holding the handle and wielding the exercising device drives the swing arm to rotate around the proximal end of the handle.

3. The exercising device of claim 2, further comprising:

at least one weight member, wherein the at least one weight member is capable of being removably coupled to a weight member recess located in the swing arm.

4. The exercising device of claim 3, further comprising:

a safety sleeve capable of being removably coupled to the swing arm and partially or wholly covering the at least one weight member recess thereby preventing the at least one weight member from becoming disengaged from the weight member recess.

5. The exercising device of claim 1, further comprising:

a grip cover covering the handle.

6. The exercising device of claim 1, further comprising:

a handle strap having an anchoring end and an adjustable end, wherein the anchoring end is coupled to a connecting shaft and the adjustable end removably couples to the distal end of the handle.

7. The exercising device of claim 6, wherein there are a plurality of adjustment holes disposed on the handle strap and wherein there is a protruding member on the distal end of the handle, wherein the protruding member is capable of being removably inserted into each of the plurality of adjustment holes.

8. The exercising device of claim 7, further comprising:

a handle cap capable of coupling to the distal end of the handle thereby preventing the adjustment end of the handle strap from being detached from the distal end of the handle.

9. The exercising device of claim 1, wherein the swing arm has a first section in proximity to the first end and a second section in proximity to the second end.

10. The exercising device of claim 9, wherein the first section is perpendicular to the handle, and the second section and the handle form an obtuse angle.

11. An exercising device, comprising:

a handle having a proximal end and a distal end;

a swing arm having a first end, a second end, a shaft hole proximally located to the first end, and a weight member recess proximally located to the second end, wherein the swing arm has a first section located proximally to the first end, and a second section located proximally to the second end, and wherein the first section is perpendicular to the handle, and the second section and the handle form an obtuse angle;

a connecting shaft coupled to the proximal end of the handle, wherein a front end of the connecting shaft is inserted into the shaft hole thereby allowing the first end of the swing arm to be rotatably connected to the proximal end of the handle, and wherein holding the handle and wielding the exercising device causes the swing arm to rotate around the proximal end of the handle, and wherein the connecting shaft has a shaft diameter larger than a diameter of the handle;

a swing arm locator removably coupled to the connecting shaft thereby preventing the connecting shaft from dislodging from the shaft hole;

a weight member, wherein the weight member is positioned in the weight member recess and removably coupled to the swing arm;

a safety sleeve removably coupled to the swing arm and partially or wholly covering the weight member recess thereby preventing the weight member from disengaging from the weight member recess;

a grip cover covering the handle;

a handle strap having an anchoring end and an adjustable end, wherein the anchoring end couples to the connecting shaft, and wherein the adjustable end is removably coupled to the distal end of the handle; and a handle cap capable of covering the distal end of the handle thereby preventing the adjustment end of the handle strap from becoming detached from the distal end of the handle;

wherein the handle has a length of about 12 cm to about 18 cm, the first section of the swing arm has a length of about 6 cm to about 9 cm, the second section of the swing arm has a length of about 20 cm to about 30 cm, the handle has a diameter of about 2 cm to about 4 cm, and the connecting shaft has a diameter of about 4 cm to about 8 cm.

12. The exercising device of claim 11, wherein the swing arm and the handle are made from plastic, the weight member is made from metal, the safety sleeve and the handle strap are made from rubber, and the grip cover is made from foam.

13. The exercising device of claim 11, wherein there are a plurality of adjustment holes on the adjustable end of the handle strap and wherein there is a protruding member on the distal end of the handle, wherein the protruding member is capable of being inserted into each of the plurality of adjustment holes.

14. The exercising device of claim 12, wherein the connecting shaft has a swing arm stopper, the swing arm being blocked by the swing arm stopper thereby preventing the front end of the connecting shaft from disengaging from the shaft hole.

* * * * *